US009387157B2

(12) United States Patent
Archer et al.

(10) Patent No.: US 9,387,157 B2
(45) Date of Patent: Jul. 12, 2016

(54) NIPPLE

(71) Applicant: Jackel Trade Marks Pty Limited, Rydalmere (AU)

(72) Inventors: Sandra Joy Archer, Bayview (AU); Arnold Rees, Whitebridge Park (AU); David A Tesini, Hopkinton, MA (US); Joshua Wiesman, Boston, MA (US)

(73) Assignee: Jackel International Limited (GB)

( * ) Notice: Subject to any disclaimer, the term of this patent is extended or adjusted under 35 U.S.C. 154(b) by 0 days.

(21) Appl. No.: 14/390,180

(22) PCT Filed: Apr. 2, 2013

(86) PCT No.: PCT/AU2013/000340

§ 371 (c)(1),
(2) Date: Oct. 2, 2014

(87) PCT Pub. No.: WO2013/149295

PCT Pub. Date: Oct. 10, 2013

(65) Prior Publication Data

US 2015/0053637 A1 Feb. 26, 2015

(30) Foreign Application Priority Data

Apr. 20, 2012 (AU) ..... 2012901568

(51) Int. Cl.
*A61J 11/00* (2006.01)
*A61J 11/04* (2006.01)

(52) U.S. Cl.
CPC ..... *A61J 11/00* (2013.01); *A61J 11/006* (2013.01); *A61J 11/0065* (2013.01); *A61J 11/04* (2013.01); *A61J 17/001* (2015.05)

(58) Field of Classification Search
CPC ..... A61J 11/00; A61L 11/0065
USPC ..... 215/11.1
See application file for complete search history.

(56) References Cited

U.S. PATENT DOCUMENTS

| | | | | |
|---|---|---|---|---|
| 1,902,433 | A * | 3/1933 | Brown | A61J 11/00 215/11.1 |
| 3,113,569 | A | 12/1963 | Barr et al. | |
| 5,544,766 | A | 8/1996 | Dunn et al. | |
| D444,239 | S * | 6/2001 | Kobayashi | D24/196 |
| D464,434 | S | 10/2002 | Morano | |
| 2004/0220618 | A1* | 11/2004 | Rohrig | A61J 11/0035 606/234 |
| 2008/0210655 | A1* | 9/2008 | Rees | A61J 11/006 215/11.5 |
| 2009/0139950 | A1 | 6/2009 | Greter et al. | |
| 2009/0200257 | A1* | 8/2009 | McKendry | A61J 9/04 215/11.5 |
| 2011/0114590 | A1* | 5/2011 | Ajmera | A61J 9/00 215/11.5 |
| 2012/0267334 | A1* | 10/2012 | Yamashita | A61J 11/02 215/11.5 |

FOREIGN PATENT DOCUMENTS

| | | |
|---|---|---|
| DE | 202011052329 | 1/2012 |
| DE | 202011052329 | 3/2012 |
| GB | 2448248 | 10/2008 |
| JP | 2002011076 | 1/2002 |

* cited by examiner

*Primary Examiner* — Sue A Weaver
(74) *Attorney, Agent, or Firm* — Kartsounes Law, LLC

(57) ABSTRACT

There is disclosed a nipple (10) suitable for a soother, feeding bottle or drinking vessel. The nipple (10) has a teat portion (12), an areola portion (14) and a base portion (16). The nipple (10) has an interior wall (15) and a plurality of paths (20), prefereably at least partly recessed, in the interior wall (15). Each path (20) has a first end (25) located in the teat portion (12) and a second end (26) located in the areola portion (14).

6 Claims, 10 Drawing Sheets

NIPPLE

FIELD OF THE INVENTION

The invention relates to a nipple, in particular a nipple for a soother, feeding bottle or drinking vessel.

BACKGROUND OF THE INVENTION

Nipples for use on feeding bottles for infants, on other drinking vessels such as lidded cups and as part of soothers (comforters) often suffer from the drawback that they work in a manner which is dissimilar to that of an anatomical nipple.

It is an object of the present invention, at least in some embodiments, to provide a nipple which can mimic an anatomical nipple, or at least provide a useful alternative.

This application claims priority of Australia provisional patent application no. 2012901568 and of part of International patent Application No. PCT/US2102/031787. The contents of the specifications of both applications are incorporated herein by reference.

SUMMARY OF THE INVENTION

According to the present invention there is provided a nipple which is suitable for a soother, feeding bottle or drinking vessel, the nipple including a teat portion, an areola portion and a base portion, the nipple having an interior wall and a plurality of paths for the interior wall, each path having a first end located in the teat portion of the nipple and a second end located in the areola portion of the nipple.

In chosen embodiments, each path is proud of the interior wall or at least partly recessed in the interior wall, or a combination of these.

In one preferred embodiment of the nipple, each path for the interior wall is recessed from the first end to the second end. Thus, in this embodiment the entire path is recessed.

In other preferred embodiments, each path has a first segment which is proud of, and a second segment which is recessed into, the interior wall of the nipple.

In one embodiment of the invention, each path is proud of the interior wall of the nipple at or near the first end and gradually changes so that it is recessed at or near the second end.

It is also within the scope of the invention that each path forms a rib standing proud of the interior wall. Optionally, each rib gradually decreases in height so as to end flush with the interior wall.

In a further preferred embodiment of the nipple, each path is wider at the second end than at the first end. In this embodiment, preferably each path becomes progressively wider as the path extends from the first end to the second end.

It is preferred that at least part of each path is curved.

In an alternative preferred embodiment, the path is similar in shape to a 'J' with a generally less curved part and a generally more curved part, the generally less curved part of the path located nearer the first end and the generally more curved part located nearer the second end. The generally less curved part may be substantially linear, or a gentle curve, for example.

In certain preferred embodiments, the paths of the nipple at or near the second end curve to follow at least part of the circumference of the nipple. It is found that at least in some embodiments, this promotes flexing and stretching of the nipple. When an infant feeds from a nipple, the natural sucking action moves the central axis of the nipple relative to the bottle. Therefore, some areas of the nipple are under tension and compression as the nipple flexes. During such cycle, regions of the teat and areola stretch and relax due to the sucking action used by the infant. It has been found that the flexing and stretching of the nipple may be enhanced, relative to the case of a nipple of generally even wall thickness, in regions where the thickness of the interior wall is altered by the presence of the path. The flexing of the nipple can include a bobbing up and down movement of the teat portion axially along its central axis, and the stretching in this region of the teat portion can include a tilting in a direction transverse to this'central axis. The enhanced bobbing and tilting movements of the nipple is intended to make it more precisely mimic the movement of a natural nipple.

In certain preferred embodiments of the nipple, each path has a segment proud of the interior wall in the teat portion, the proud segments being intended to prevent the interior wall of the teat portion collapsing when compressed. This feature is particularly suitable for nipples adapted for use with a feeding bottle or drinking vessel, to assist with the flow of fluid through the teat portion. The incorporation of suitably positioned proud segments in each path in the teat portion ensures that when the teat portion is compressed the interior wall does not collapse, because of the resistance provided by the proud segments.

The nipple is preferably adapted to have a flanged portion below the base portion, the flanged portion being suitable for engaging with a feeder bottle or drinking vessel, or a shield for a soother, as appropriate.

The nipple is preferably made from a soft synthetic compound such as silicone, but may be manufactured from any suitable material.

The nipple may take a variety of overall shapes; the nipple may be tall with a smaller diameter or short with a larger diameter, for example.

There are at least two paths in the nipple of the invention. Preferably, there are three such paths, but there may be more—for example, four or five paths.

BRIEF DESCRIPTION OF THE DRAWINGS

Possible and preferred features of the present invention will now be described with particular reference to the accompanying drawings.

The drawings are not drawn to a particular or consistent scale and should not be regarded as limiting the intended shape or size of preferred embodiments, or particular features, that the invention discloses.

Figure 1:
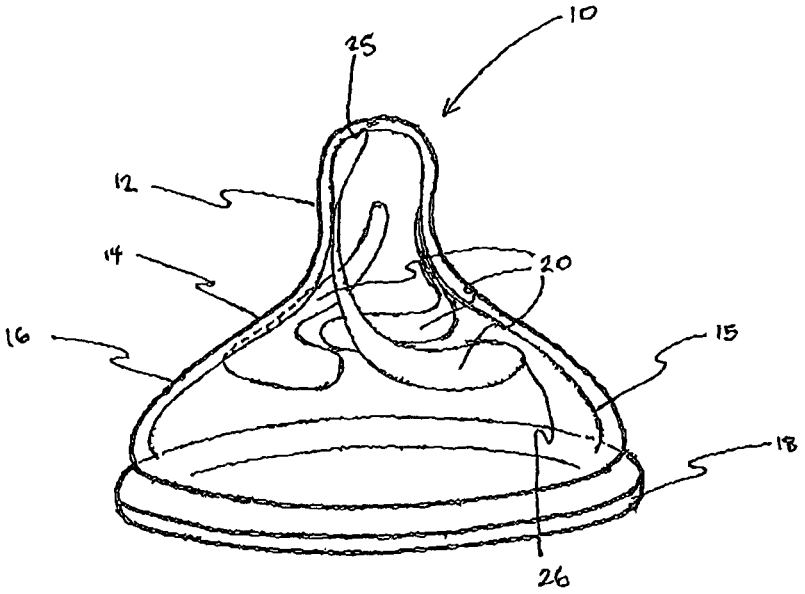

Further, it is to be understood that the features illustrated in and described with reference to the drawings are not to be construed as limiting on the scope of the invention.

Figure 2:
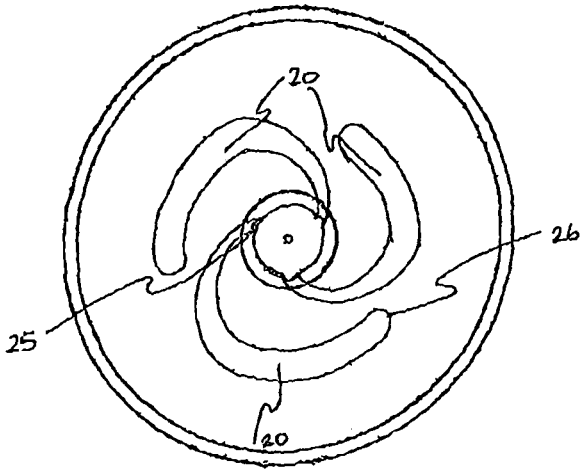
Figure 3:
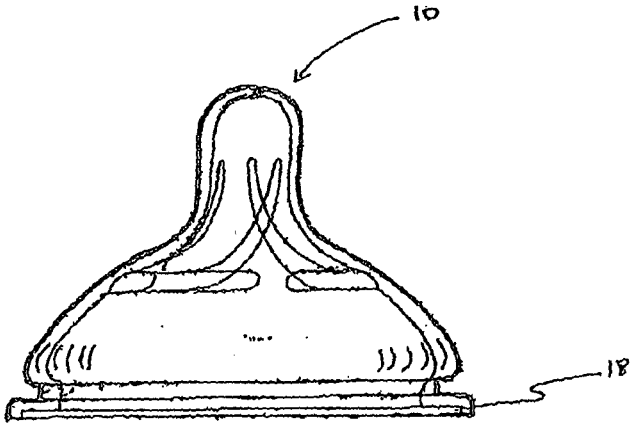
Figure 4:
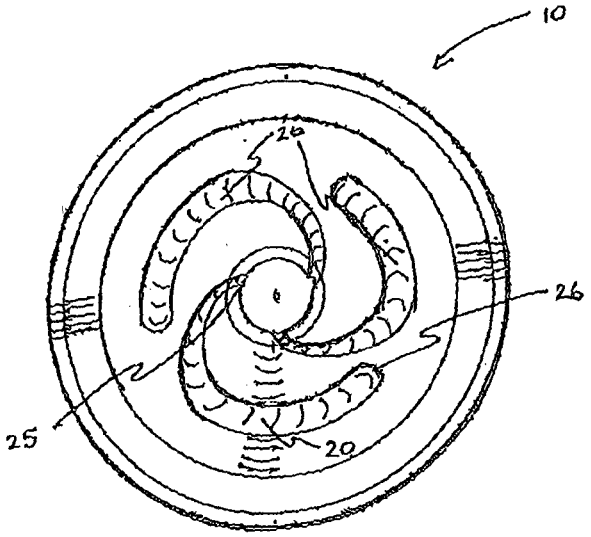
Figure 5:
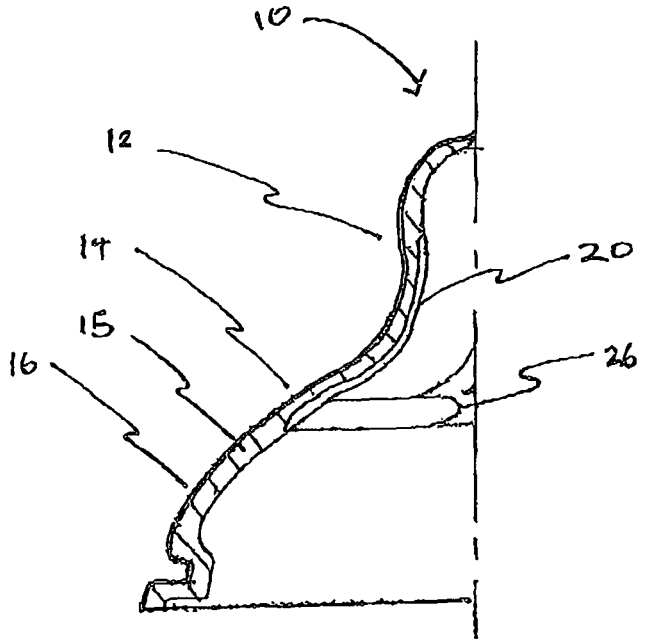
Figure 6:
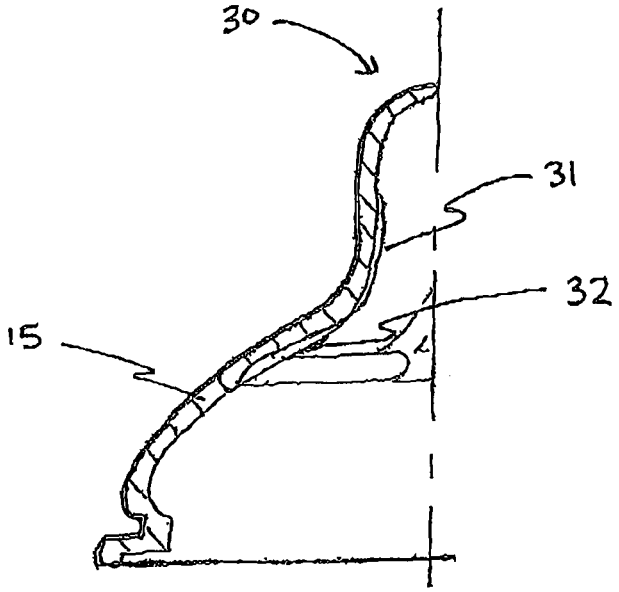
Figure 7:
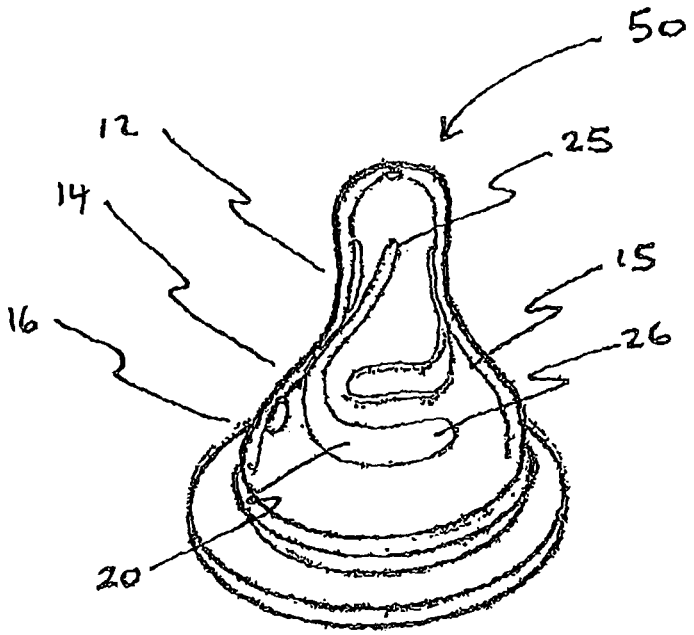
Figure 8:
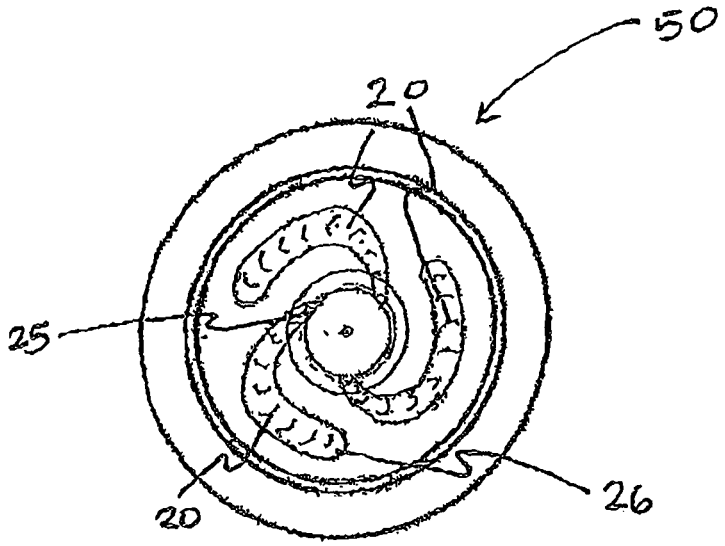
Figures 9, 9A:
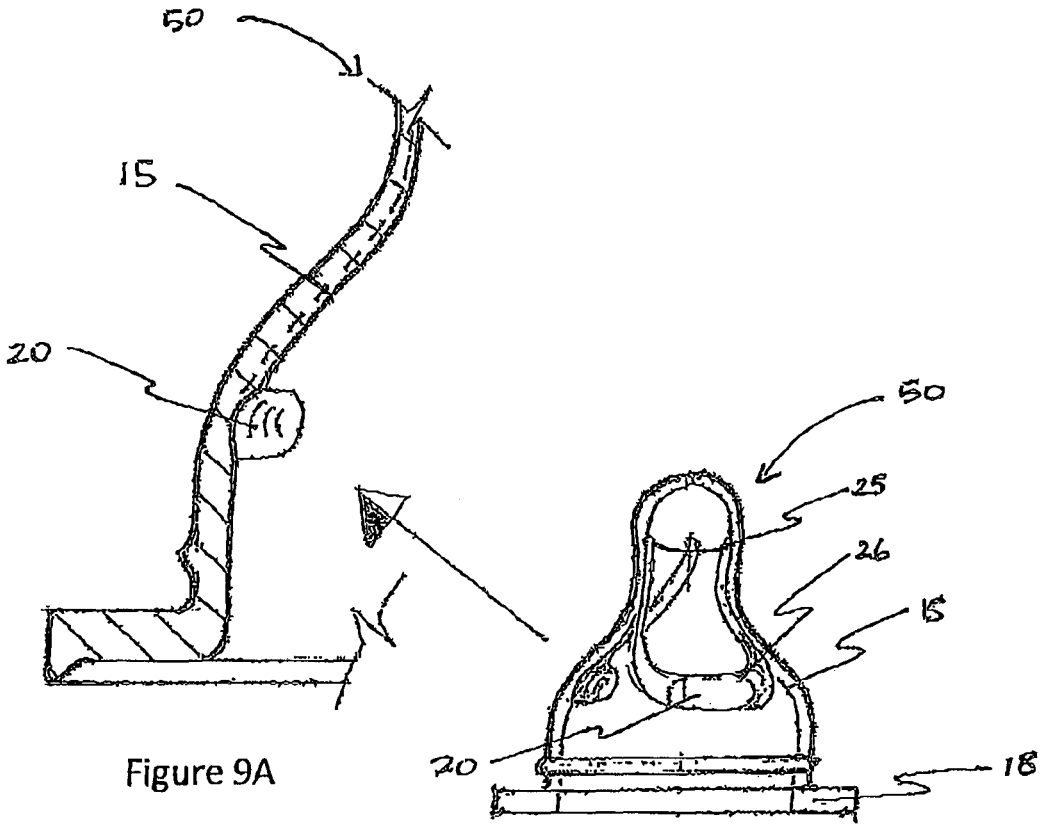
Figure 10:
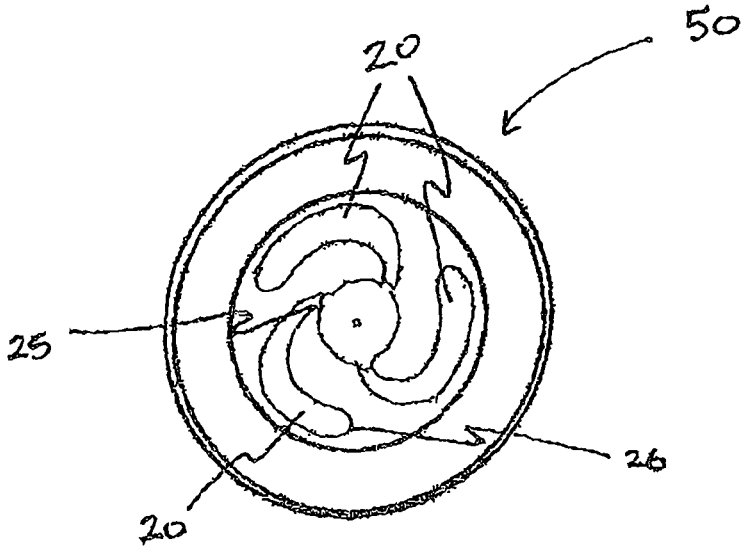
Figure 11:
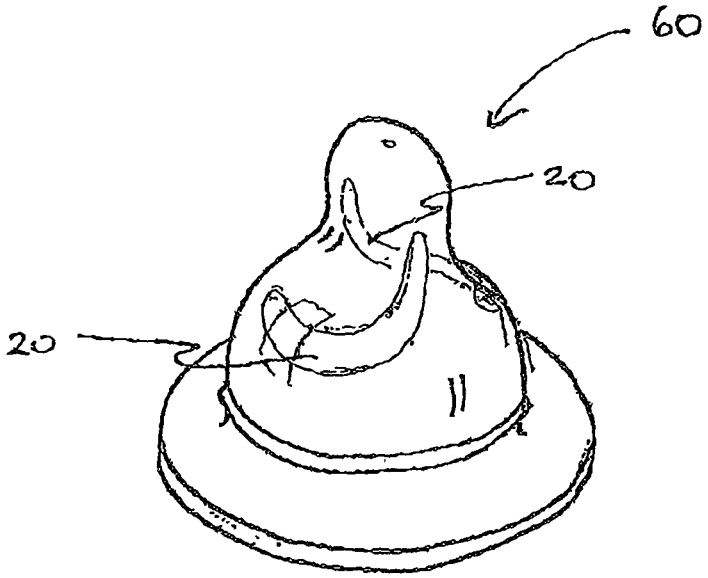
Figure 12:
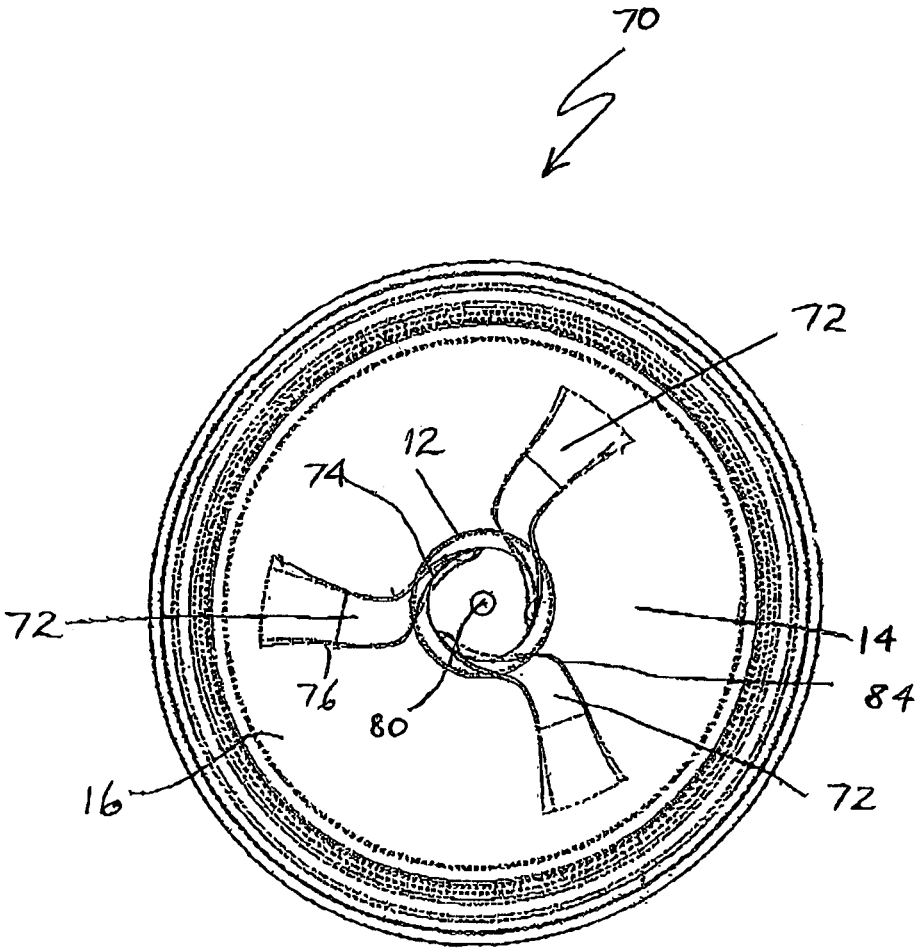
Figure 13:
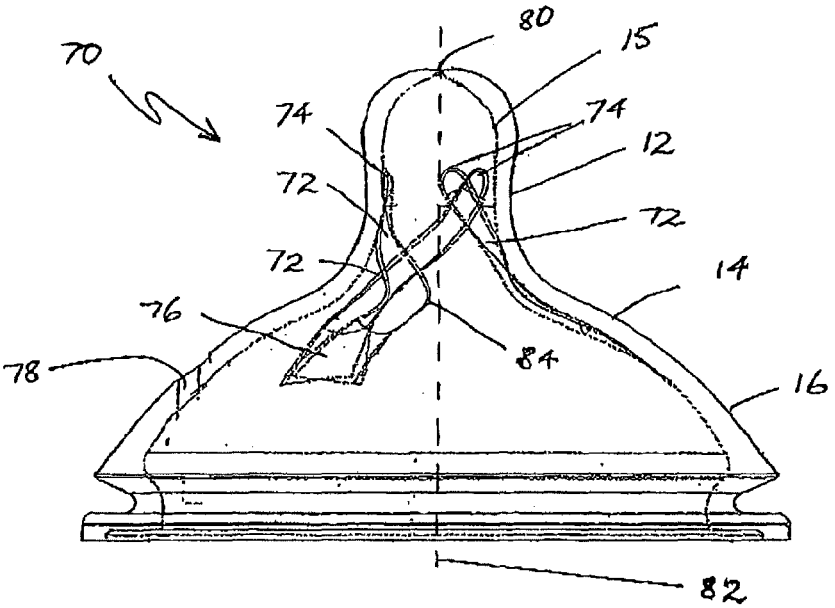
Figure 14:
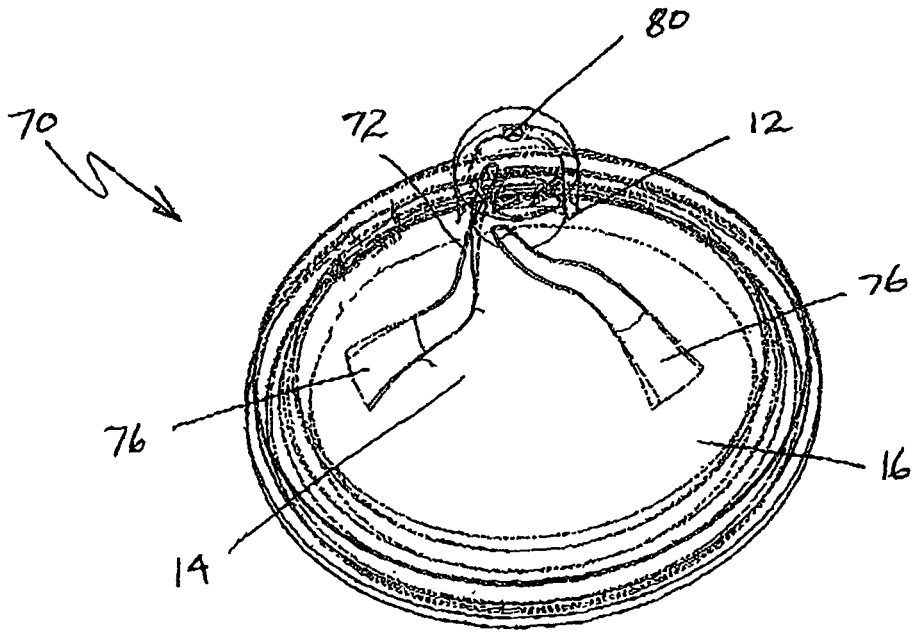
Figure 15:
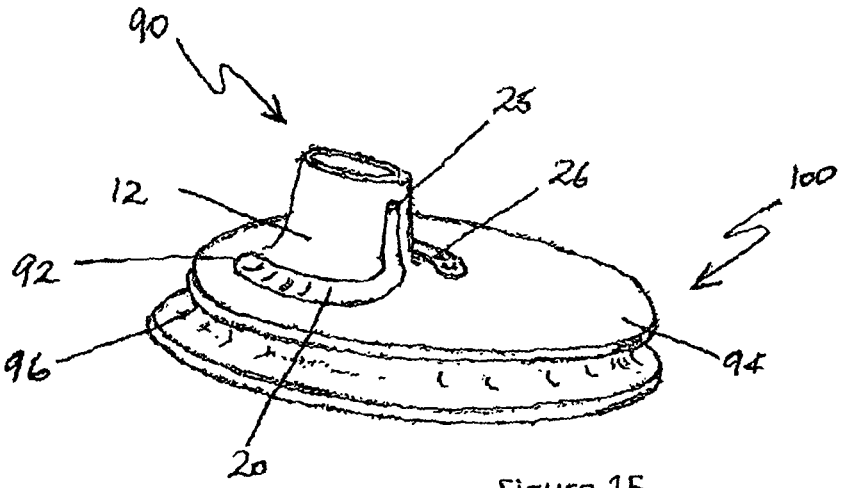
Figure 16:
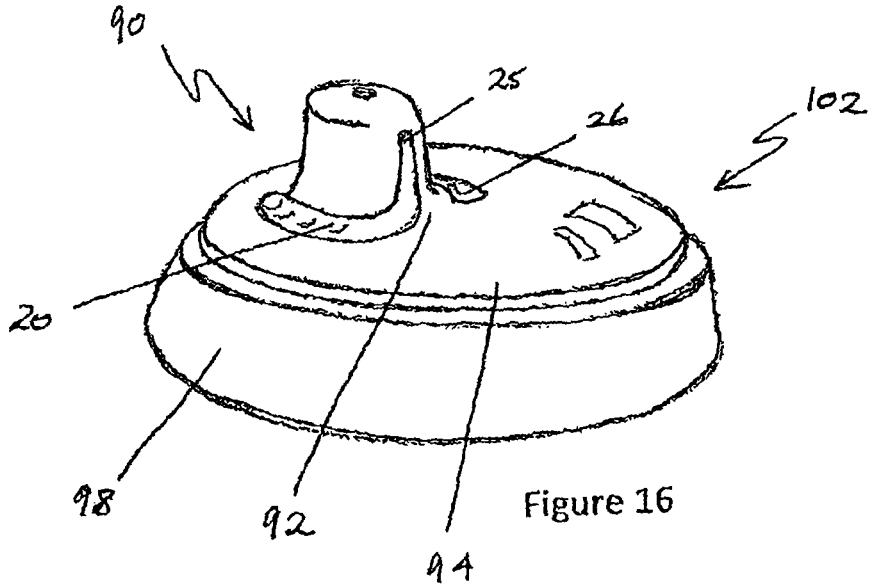

In the drawings:

FIG. 1 is an isometric front view of a first embodiment of the nipple;

FIG. 2 is a plan view from above of the nipple of FIG. 1;

FIG. 3 is a side view of the nipple of FIG. 1;

FIG. 4 is a plan view from below of the nipple of FIG. 1;

FIG. 5 is a partial sectional view of the nipple of FIG. 1, helping to illustrate that in this embodiment the full length of the path is recessed in the interior wall of the nipple;

FIG. 6 is a partial sectional view of a second embodiment of the invention, where the path is proud of the interior wall at a first end located in the teat portion and then changes to become recessed at or near the second end;

FIG. 7 is an isometric front view of a third embodiment of the invention, being a smaller diameter nipple;

FIG. 8 is a plan view from below of the nipple of FIG. 7;

FIG. 9 is a side view of the nipple of FIG. 7;

FIG. 9A is an enlarged cross-sectional detail of part of the left hand wall of the nipple of FIG. 9;

FIG. 10 is a plan view from above of the nipple of FIG. 7;

FIG. 11 is an isometric front view of a fourth embodiment of the nipple, with two paths;

FIG. 12 is a top plan view of another embodiment of the nipple of the invention;

FIG. 13 is a side elevation of the nipple of FIG. 12;

FIG. 14 is a perspective view of the nipple of FIGS. 12 and 13;

FIG. 15 is a perspective view of a further embodiment of the nipple of the invention, used on a soft lid for a cup; and FIG. 16 is a perspective view of the nipple, similar to that of FIG. 15, but used on a cup lid where the top of the lid is soft and the skirt of the lid is hard.

DETAILED DESCRIPTION OF THE DRAWINGS

In the description below, the same numeral will be used to identify common parts in the various embodiments.

Referring first to FIGS. 1 to 4, a first embodiment of the nipple (10) is depicted. Nipple (10) is made of clear silicon; hence details inside nipple (10) are visible in this view. Nipple (10) is composed of a teat portion (12), an areola portion (14) and a base portion (16). There are three paths (20), each having a first end (25) and a second end (26) along the interior wall (15). In this first embodiment, the shape of the paths is similar to a 'J' with a generally less curved part located nearer to first end (25) and a generally more curved part located nearer the second end (26). The whole length of each path (20) is recessed into interior wall (15).

FIG. 2 shows that each path (20) is wider at second end (26) than at first end (25).

Flanged portion (18) below the base portion (16) of nipple (10) is most clearly shown in FIGS. 1 and 3.

FIG. 4 also illustrates how each path (20) progressively widens as it extends from the first end (25) to second end (26).

In FIG. 5, which shows only the left hand part of nipple (10), path (20) has begun at the teat portion (12) and extends through into the areola portion (14). In this embodiment, path (20) is recessed into interior wall (15) along its entire length from the first end (25) (not shown in this Figure) to the second end (26).

FIG. 6 shows a second embodiment of the nipple (30). In this embodiment, the path is proud of interior wall (15) for a first segment (31), and recessed into interior wall (15) for a second segment (32).

In FIGS. 7 to 9, a third embodiment of the nipple (50) is depicted. The nipple (50) is composed of a teat portion (12), an areola portion (14) and a base portion (16). There are three paths (20), each having a first end (25) and a second end (26) along the interior wall (15). The nipple (50) in the third embodiment has a smaller diameter than that of the first embodiment, but is otherwise similar.

In this third embodiment, as shown in FIG. 9A, each path (20) is recessed along its entire length into interior wall (15) of nipple (50).

In FIG. 10, a plan view from above of the third embodiment of the nipple (50), it is apparent that each path (20) progressively widens as it extends from the first end (25) to the second end (26).

In FIG. 11, an isometric front view of the fourth embodiment of the nipple (60), the nipple (60) has two paths (20) and shows how the flexing feature can be applied to an orthodontic, or anatomical, nipple shape.

Turning now to FIGS. 12 to 14, nipple (70) has a teat portion (12), an areola portion (14) and a base portion (16). Nipple (70), being clear so that interior details are visible, has an interior wall (15) and a plurality of paths (72) for interior wall (15). Each path (72) has a first end (74) located in the teat portion (12) of nipple (70) and a second end (76) located in the areola portion (14) of nipple (70).

Nipple (70) includes a valve (78) of suitable design, indicated generally in FIG. 13 but not shown in the other Figures.

Paths (72) help to maintain an open flow path in nipple (70), even if an infant bites down on teat (70).

Second end (76) of path (72) is generally radial with respect to centreline (82) (FIG. 13), running vertically through orifice (80). Path (72) changes in direction at (84) to one that is angled inside teat portion (12). This configuration can prevent nipple (70) from fully collapsing if bitten down on by an infant.

The angle of first end (74) relative to centreline (82) is typically between about 45 degrees and about 75 degrees; an angle of about 65 degrees is illustrated.

Paths (72) are typically about 5 mm wide at second end (76) and taper to about 2 to 4 mm wide at first end (74).

Paths (72) protrude from inner wall (15) typically about 2 mm, plus or minus 1 mm, at first end (74). In this embodiment, paths (72) gradually decrease in height so as to end flush with interior wall (15) at second end (76).

Paths (72) allow nipple (70) to stretch in the infant's mouth while sucking, at the same time preventing base portion (16) from collapsing or kinking inwards under a stretch force. This inward stretch is similar to the action of the nipple of a breast during breastfeeding.

Nipple (90) in FIGS. 15 and 16 is similar to nipple (50) in FIGS. 7 to 9, but is incorporated in a cup lid. In both FIGS. 15 and 16, cup lid (100, 102) has an areola portion (92) and a base portion (94).

Cup lid (100) in FIG. 15 has a skirt (96). All of cup lid (100), including skirt (96), and is made completely of a transparent, soft, relatively flexible plastic material.

In FIG. 16, cup lid (102) has a skirt (98), made of a relatively hard opaque plastic, with an internal screw thread (not visible), for connection to a cup base (not shown). The remainder of cup lid (102) is made of a transparent, soft, relatively flexible plastic material.

The embodiments described above relate to preferred embodiments only of the present invention and are given by way of illustration. Changes, modifications and variations may be made without departing from the spirit or scope of the present invention.

INDUSTRIAL APPLICABILITY

The nipple of the invention is especially useful since, in at least some embodiments, it provides a nipple which closely mimics an anatomical nipple. An infant may more readily accept such a nipple which works similarly to a natural nipple and readily switch between the natural nipple and the nipple of the invention. One of the drawbacks of breastfeeding lies in a problem in having the infant accept expressed breast milk from a feeding bottle, so that the breastfeeding mother can have the infant fed by another. In some cases, an infant refuses to accept bottle feeding, perhaps because the nipple on the bottle seems very different to the infant. In other cases, the infant may prefer the bottle nipple and reject breastfeeding. Consequently, the nipple of the invention, when it closely mimics a natural nipple, may enhance natural breast feeding and enable the mother to breastfeed over a longer period.

The invention claimed is:

1. A nipple suitable for a soother, feeding bottle or drinking vessel, the nipple including a teat portion, an areola portion and a base portion, the nipple having an interior wall and a plurality of paths for the interior wall, each path having a first end located in the teat portion of the nipple and a second end located in the areola portion of the nipple, wherein each path has a first segment which is proud of the interior wall and a second segment which is recessed in the interior wall.

2. The nipple of claim 1, wherein at least part of each path is curved.

3. The nipple of claim 1, wherein each path resembles a 'J,' having a generally less curved part located nearer the first end and a more curved part located nearer the second end.

4. The nipple of claim 1, wherein each path is wider at the second end than at the first end.

5. The nipple of claim 1, having three said paths.

6. The nipple of claim 1, when made solely of predominantly or silicon.

* * * * *